US010010900B2

(12) United States Patent
Mohanty et al.

(10) Patent No.: US 10,010,900 B2
(45) Date of Patent: Jul. 3, 2018

(54) AUTOMATED MULTIPLE HEAD CLEANER FOR A DISPENSING SYSTEM AND RELATED METHOD

(71) Applicant: Illinois Tool Works Inc., Glenview, IL (US)

(72) Inventors: Rita Mohanty, East Greenwich, RI (US); Robert W. Tracy, Haverhill, MA (US); Scott A. Reid, Bradford, MA (US)

(73) Assignee: Illinois Tool Works Inc., Glenview, IL (US)

( * ) Notice: Subject to any disclaimer, the term of this patent is extended or adjusted under 35 U.S.C. 154(b) by 23 days.

(21) Appl. No.: 15/278,490

(22) Filed: Sep. 28, 2016

(65) Prior Publication Data

US 2017/0014847 A1 Jan. 19, 2017

Related U.S. Application Data

(62) Division of application No. 13/663,028, filed on Oct. 29, 2012, now Pat. No. 9,475,078.

(51) Int. Cl.
*B05B 15/02* (2006.01)
*B05C 5/02* (2006.01)
(Continued)

(52) U.S. Cl.
CPC ..... *B05B 15/0208* (2013.01); *B05B 15/52* (2018.02); *B05C 5/02* (2013.01); *B05C 5/027* (2013.01); *B08B 9/035* (2013.01)

(58) Field of Classification Search
CPC ..... B05B 15/0208; B05C 5/02; B05C 5/027; B08B 9/035
(Continued)

(56) References Cited

U.S. PATENT DOCUMENTS 5,044,900 A 9/1991 Cavallaro
5,795,390 A 8/1998 Cavallaro
(Continued)

FOREIGN PATENT DOCUMENTS

CN 1619364 A 5/2005
CN 101678383 A 3/2010
JP 2002 143744 A 5/2002

OTHER PUBLICATIONS

Taiwan Search Report from corresponding Taiwan Patent Application No. 102135886 dated Apr. 28, 2017.
(Continued)

*Primary Examiner* — Alexander Marion Weddle
(74) *Attorney, Agent, or Firm* — Lando & Anastasi, LLP

(57) ABSTRACT

A material deposition system is configured to deposit material on an electronic substrate, such as a printed circuit board. The material deposition system includes a frame, a support coupled to the frame and configured to support an electronic substrate during a deposit operation, a gantry coupled to the frame, and two deposition heads coupled to the gantry. Each deposition head includes a needle, with the deposition heads being movable over the support by movement of the gantry. The material deposition system further includes a needle cleaner assembly movable on a needle cleaner gantry, with the needle cleaner assembly being configured to clean needles of the deposition heads. The material deposition system further includes a controller configured to control the operation of the needle cleaner assembly to perform a needle cleaning operation.

9 Claims, 8 Drawing Sheets

(51) Int. Cl.
*B08B 9/035* (2006.01)
*B05B 15/52* (2018.01)

(58) Field of Classification Search
USPC ..... 427/427.3
See application file for complete search history.

(56) References Cited

U.S. PATENT DOCUMENTS 5,819,983 A 10/1998 White et al.
5,837,892 A 11/1998 Cavallaro et al.
5,886,494 A 3/1999 Prentice et al.
5,903,125 A 5/1999 Prentice et al.
5,918,648 A 7/1999 Carr et al.
5,957,343 A 9/1999 Cavallaro
5,971,227 A 10/1999 White et al.
5,985,029 A 11/1999 Purcell
6,007,631 A 12/1999 Prentice et al.
6,017,392 A 1/2000 Cavallaro
6,025,689 A 2/2000 Prentice et al.
6,056,190 A 5/2000 Foulke et al.
6,082,289 A 7/2000 Cavallaro
6,085,943 A 7/2000 Cavallaro et al.
6,093,251 A 7/2000 Carr et al.
6,112,588 A 9/2000 Cavallaro et al.
6,119,895 A 9/2000 Fugere et al.
6,157,157 A 12/2000 Prentice et al.
6,170,737 B1 1/2001 Foulke et al.
6,206,964 B1 3/2001 Purcell et al.
6,214,117 B1 4/2001 Prentice et al.
6,216,917 B1 4/2001 Crouch
6,224,671 B1 5/2001 Cavallaro
6,224,675 B1 5/2001 Prentice et al.
6,258,165 B1 7/2001 Cavallaro
6,322,854 B1 11/2001 Purcell et al.
6,371,339 B1 4/2002 White et al.
6,378,737 B1 4/2002 Cavallaro et al.
6,391,378 B1 5/2002 Carr et al.
6,395,334 B1 5/2002 Prentice et al.
6,412,328 B1 7/2002 Cavallaro et al.
6,427,903 B1 8/2002 Foulke et al.
6,444,035 B1 9/2002 Nowak et al.
6,514,569 B1 2/2003 Crouch
6,540,832 B2 4/2003 Cavallaro
6,541,063 B1 4/2003 Prentice et al.
6,641,030 B1 11/2003 Freeman et al.
6,644,238 B2 11/2003 Watts et al.
6,688,458 B2 2/2004 Prentice et al.
6,739,483 B2 5/2004 White et al.
6,775,879 B2 8/2004 Bibeault et al.
6,814,810 B2 11/2004 Prentice et al.
6,866,881 B2 3/2005 Prentice et al.
6,902,052 B2 6/2005 Prentice et al.
6,932,280 B2 8/2005 Crouch
7,316,248 B2 1/2008 Jeong et al.
7,404,861 B2 7/2008 Prentice et al.
7,744,364 B2 6/2010 Turley et al.
7,833,572 B2 11/2010 Read
7,923,056 B2 4/2011 Read
7,980,197 B2 7/2011 Prentice et al.
8,136,705 B2 3/2012 Tracy et al.
8,230,805 B2 7/2012 Read
8,424,720 B2 4/2013 Tracy et al.
2003/0066546 A1* 4/2003 Bibeault ..... B08B 5/04 134/21
2005/0235913 A1* 10/2005 Prentice ..... H05K 13/0469 118/712
2005/0255249 A1 11/2005 Schlatterbeck et al.
2006/0193969 A1 8/2006 Prentice et al.
2007/0079890 A1 4/2007 Bauer et al.
2008/0317894 A1 12/2008 Turley et al.
2010/0258592 A1 10/2010 Tracy et al.
2012/0240658 A1 9/2012 Tracy
2013/0133574 A1 5/2013 Doyle et al.
2013/0136850 A1 5/2013 Doyle et al.
2013/0177702 A1 7/2013 Crouch et al.
2013/0269731 A1 10/2013 Crouch et al.
2014/0120241 A1 5/2014 Mohanty et al.

OTHER PUBLICATIONS

Notification of Transmittal of the International Search Report and the Written Opinion of the Internatonal Searching Authority from corresponding PCT/US2013/063880 dated Apr. 10, 2014.

* cited by examiner

AUTOMATED MULTIPLE HEAD CLEANER FOR A DISPENSING SYSTEM AND RELATED METHOD

CROSS-REFERENCE TO RELATED APPLICATIONS

This patent application is a divisional patent application of U.S. patent application Ser. No. 13/663,028 filed on Oct. 29, 2012, entitled, "AUTOMATED MULTIPLE HEAD CLEANER FOR A DISPENSING SYSTEM AND RELATED METHOD," which is hereby incorporated by reference in its entirety for all purposes.

BACKGROUND OF THE DISCLOSURE

1. Field of the Disclosure

This disclosure relates generally to systems and methods for depositing a material on a substrate, such as a printed circuit board, and more particularly to an apparatus and a method for depositing viscous materials, such as solder paste, epoxies, underfill materials, encapsulants, and other assembly materials, on electronic substrates.

2. Discussion of Related Art

There are several types of prior art dispensing systems used for dispensing precise amounts of liquid or paste for a variety of applications. One such application is the assembly of integrated circuit chips and other electronic components onto circuit board substrates. In this application, automated dispensing systems are used for dispensing very small amounts, or dots, of viscous material onto a circuit board. The viscous material may include liquid epoxy or solder paste, or some other related material.

One challenge facing operators of such dispensing systems is the ability to sufficiently clean nozzles or needles of the dispensing heads from which material exits. This challenge is made more difficult by the inclusion of multiple nozzles and the continuous drive to lowering cycle time for circuit board assembly process.

SUMMARY OF THE DISCLOSURE

The present disclosure offers an effective and repeatable cleaning system and method that eliminates operator intervention, is user friendly, and improves process cycle time. Current and future dispenser operators may employ multiple head systems (systems employing two or more dispensing heads) in conjunction with a multiple needle cleaner assembly to improve cycle time and yield while avoiding manual intervention and adjustment to position the needle cleaner with respect to the dispensing heads.

One aspect of the disclosure is directed to a material deposition system for depositing material on an electronic substrate. In one embodiment, the material deposition system comprises a frame, a support coupled to the frame and configured to support an electronic substrate during a deposit operation, a gantry coupled to the frame, and two deposition heads coupled to the gantry. Each deposition head includes a needle, with the deposition heads being movable over the support by movement of the gantry. The material deposition system further comprises a needle cleaner assembly movable on a needle cleaner gantry, with the needle cleaner assembly being configured to clean needles of the deposition heads. The material deposition system further comprises a controller configured to control the operation of the needle cleaner assembly to perform a needle cleaning operation.

Embodiments of the material deposition system further may include a vision system configured to obtain images of the deposition heads and the needle cleaners. The needle cleaner assembly may include a base plate secured to a needle cleaner gantry. The needle cleaner assembly further may include two needle cleaners, one for each deposition head, secured to the base plate. Each needle cleaner may include a cap that is seated within its respective needle cleaner. Each cap may include a plurality of orifices configured to receive needles of the deposition head. The plurality of orifices may be sized to receive needles having different diameters. The material deposition system further may comprise a rotary indexer to rotate the cap to select a correct size of the needle orifice. The needle cleaner further may include a connector that provides communication with the controller. The controller may be configured to determine a distance between each deposition head and a distance between each needle cleaner.

Another aspect of the disclosure is directed to a method for automatically cleaning nozzles of a material deposition system configured to deposit material on an electronic substrate. In one embodiment, the method comprises: performing a deposition operation with a material deposition system configured to position an electronic substrate under two deposition heads movable by a gantry; and cleaning needles of the two deposition heads simultaneously with a needle cleaner assembly.

Embodiments of the method further may include verifying a size of a needle orifice, and/or operating a rotary indexer to select a correct size of the needle orifice and to move the proper needle orifice into place. Cleaning needles of the two deposition heads may include setting a vision system offset for both deposition heads. Cleaning needles of the two deposition heads further may include adjusting a spacing of the needles by fixing the position of one needle and adjusting the position of the other to a desired position. Adjusting the spacing of the needles may performed by a controller of the dispenser. The spacing of the needles may be displayed on a display of the dispenser. If the spacing of the needles is not within a predetermined tolerance, then the adjustable needle may be moved and the cleaning process is repeated. The needle cleaner assembly may be mounted to an X-axis and a Y-axis gantry.

BRIEF DESCRIPTION OF THE DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION OF THE DISCLOSURE

Figure 1:
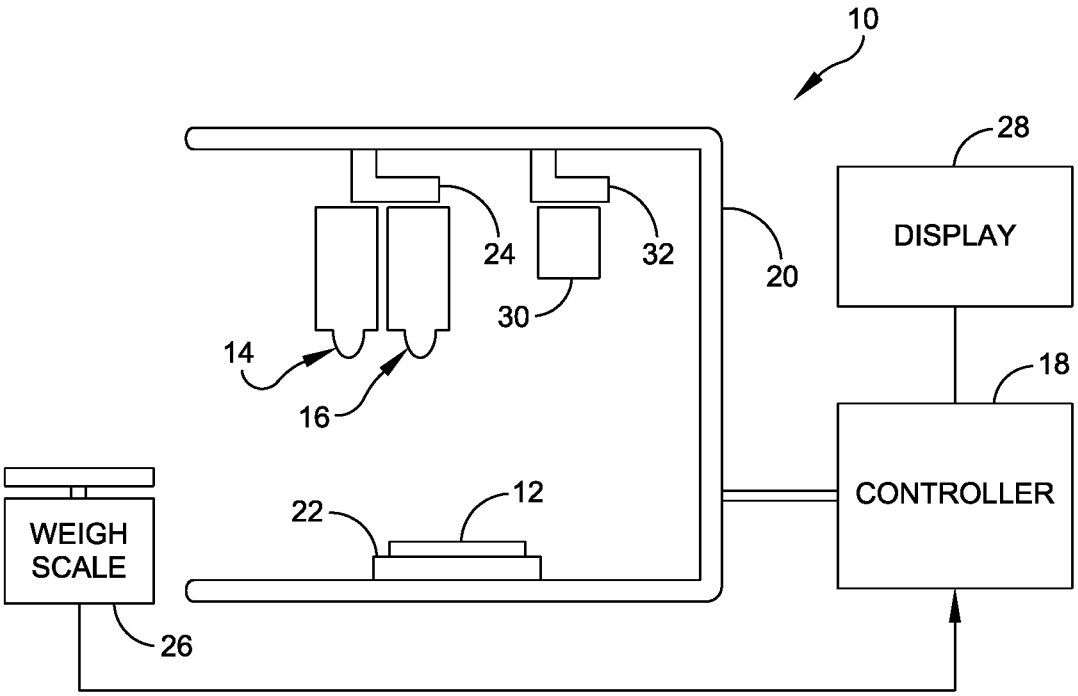
FIG. 1 is a side schematic view of a material deposition or application system.

For the purposes of illustration only, and not to limit the generality, the present disclosure will now be described in detail with reference to the accompanying figures. This disclosure is not limited in its application to the details of construction and the arrangement of components set forth in the following description or illustrated in the drawings. The principles set forth in this disclosure are capable of other embodiments and of being practiced or carried out in various ways. Also the phraseology and terminology used herein is for the purpose of description and should not be regarded as limiting. The use of "including," "comprising," "having," "containing," "involving," and variations thereof herein, is meant to encompass the items listed thereafter and equivalents thereof as well as additional items.

Various embodiments of the present disclosure are directed to material deposition or application systems, devices including such material deposition system, and methods of depositing material. Specifically, embodiments of the present disclosure are directed to dispensers used to dispense materials, such as semi-viscous and viscous materials, on an electronic substrate, such as a printed circuit board. Such materials include, and are not limited to, solder paste, epoxy, underfill materials, and encapsulants, all of which are used in the fabrication of printed circuit boards. Other less viscous materials, such as conductive inks, may also be used.

FIG. 1 schematically illustrates a dispenser, generally indicated at 10, according to one embodiment of the present disclosure. The dispenser 10 is used to dispense a viscous material (e.g., an adhesive, encapsulent, epoxy, solder paste, underfill material, etc.) or a semi-viscous material (e.g., soldering flux, etc.) onto an electronic substrate 12, such as a printed circuit board or semiconductor wafer. The dispenser 10 may alternatively be used in other applications, such as for applying automotive gasketing material or in certain medical applications. It should be understood that references to viscous or semi-viscous materials, as used herein, are exemplary and intended to be non-limiting. The dispenser 10 includes first and second dispensing units or heads, generally indicated at 14 and 16, respectively, and a controller 18 to control the operation of the dispenser. Although two dispensing units are shown, it should be understood that one or more dispensing units may be provided.

The dispenser 10 may also include a frame 20 having a base or support 22 for supporting the substrate 12, a dispensing unit gantry 24 movably coupled to the frame 20 for supporting and moving the dispensing units 14, 16, and a weight measurement device or weigh scale 26 for weighing dispensed quantities of the viscous material, for example, as part of a calibration procedure, and providing weight data to the controller 18. A conveyor system (not shown) or other transfer mechanism, such as a walking beam may be used in the dispenser 10 to control loading and unloading of substrates to and from the dispenser. The gantry 24 can be moved using motors under the control of the controller 18 to position the dispensing units 14, 16 at predetermined locations over the substrate. The dispenser 10 may include a display unit 28 connected to the controller 18 for displaying various information to an operator. There may be an optional second controller for controlling the dispensing units.

Prior to performing a dispensing operation, as described above, the substrate, e.g., printed circuit board, must be aligned or otherwise in registration with a dispenser of the dispensing system. The dispenser further includes a vision system 30, which is coupled to a vision system gantry 32 movably coupled to the frame 20 for supporting and moving the vision system. Although shown separately from the dispensing unit gantry 24, the vision system gantry 32 may utilize the same gantry system as the dispensing units 14, 16. As described, the vision system 30 is employed to verify the location of landmarks, known as fiducials or other features and components, on the substrate. Once located, the controller can be programmed to manipulate the movement of one or both of the dispensing units 14, 16 to dispense material on the electronic substrate.

Systems and methods of the present disclosure are directed to cleaning nozzles of the dispensing units 14, 16. The description of the systems and methods provided herein reference exemplary electronic substrates (e.g., printed circuit boards), which are supported on the support 22 of the dispenser 10. In one embodiment, the dispense operation is controlled by the controller 18, which may include a computer system configured to control material dispensers. In another embodiment, the controller 18 may be manipulated by an operator.

Figure 2:
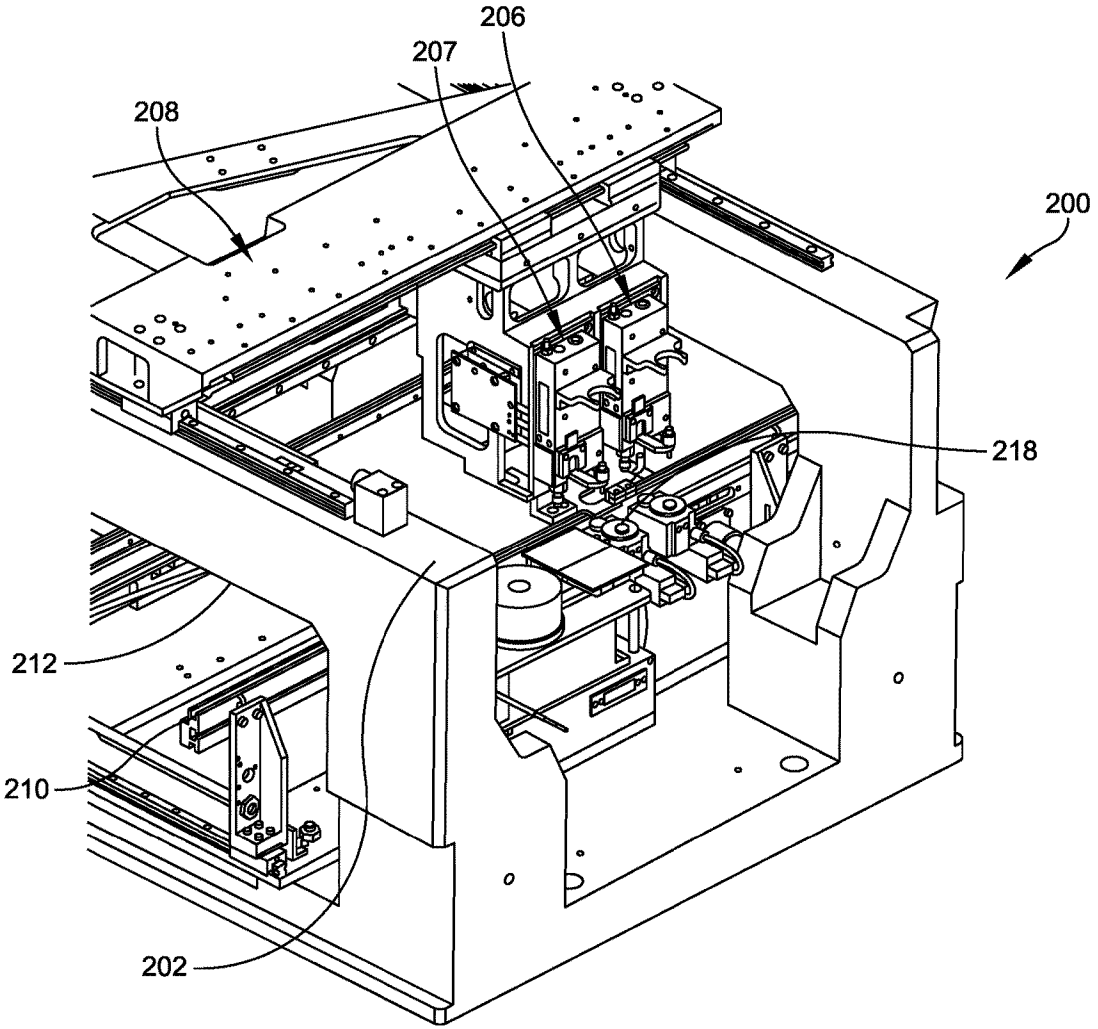
FIG. 2 is a partial perspective view of an exemplary material deposition system embodying a gantry system and two material deposition heads of an embodiment of the present disclosure.

Referring to FIG. 2, an exemplary material deposition system, generally indicated at 200, may be configured from a XYFLEXPRO® dispenser platform offered by Speedline Technologies, Inc. of Franklin, Mass. In one embodiment, the material deposition system 200 includes a frame 202 that supports components of the material deposition system, including but not limited to a controller, such as controller 18, which is located in a cabinet of the material deposition system, and two deposition or dispensing heads, generally indicated at 206 and 207, for depositing low viscous materials (e.g., less than 50 centipoise), semi-viscous materials (e.g., 50-100 centipoise), viscous materials (e.g., 100-1000 centipoise), and/or high viscous materials (e.g., greater than 1000 centipoise). The deposition heads 206, 207 may be movable along orthogonal axes by a gantry system, generally indicated at 208, under the control of the controller 18 to allow dispensing of the material on the circuit board, such as substrate 12, which, as mentioned above, may sometimes be referred to as an electronic substrate or a circuit board. A cover (not shown) may be provided but is not shown so as to reveal the internal components of the material deposition system 200, including the deposition heads 206, 207 and the gantry system 208. Although two deposition heads 206, 207 are shown and described, any number of deposition heads may be provided and fall within the scope of the present disclosure.

Circuit boards, such as substrates 12, which are fed into the material deposition system 200, typically have a pattern of pads or other surface areas onto which material will be deposited. The material deposition system 200 also includes a conveyor system 210 that is accessible through an opening 212 provided along each side of the material deposition system to transport the circuit board in an x-axis direction to a depositing position in the material deposition system. When directed by the controller of the material deposition system 200, the conveyor system 210 supplies circuit boards to a dispense location under the deposition heads 206, 207. Once arriving at the position under the deposition heads 206, 207, the circuit board is in place for a manufacturing operation, e.g., a deposition operation.

The material deposition system 200 further includes a vision inspection system, such as the vision system 30 shown in FIG. 1, that is configured to align the circuit board and to and inspect the material deposited on the circuit board. In one embodiment, the vision inspection system is secured to one of the deposition heads 206, 207 or to the gantry system 208. To successfully deposit material on the circuit board, the circuit board and the deposition heads 206, 207 are aligned, via the controller 18. Alignment is accomplished by moving the deposition heads 206, 207 and/or the circuit board based on readings from the vision inspection system. When the deposition heads 206, 207 and the circuit board are aligned correctly, the deposition heads are manipulated to perform a deposition operation. After the deposition operation, optional inspection of the circuit board by means of the vision inspection system may be performed to ensure that the proper amount of material has been deposited and that the material has been deposited at the proper locations on the circuit board. The vision inspection system can use fiducials, chips, board apertures, chip edges, or other recognizable patterns on the circuit board to determine proper alignment. After inspection of the circuit board, the controller controls movement of the circuit board to the next location using the conveyor system, where a next operation in the board assembly process may be performed, for example electrical components may be placed on the circuit board or the materials deposited on the board may be cured.

In some embodiments, the material deposition system 200 may operate as follows. The circuit board may be loaded into the material deposition system 200 in a depositing position using the conveyor system. The circuit board is aligned with the deposition heads 206, 207 by using the vision inspection system. The deposition heads 206, 207 may then be initiated by the controller 18 to perform a deposit operation in which material is deposited at precise locations on the circuit board. Once the deposition heads 206, 207 have performed a depositing operation, the circuit board may be transported by the conveyor system from the material deposition system 200 so that a second, subsequent circuit board may be loaded into the material deposition system.

To improve the performance of the material deposition system 200, the deposition heads 206, 207 require frequent cleaning. Material has a tendency to adhere and potentially clog orifices of needles of the deposition heads, so more effective ways of cleaning the heads are desired. The present disclosure is directed to a multiple needle cleaner assembly indicated at 218 that can be adjusted manually or automatically to work with a multiple head dispenser (a dispenser having two or more dispensing heads). Systems and methods of the present disclosure enable an operator of the material deposition system 200 to automatically verify and select the proper orifice to match the needle size. The object is to lower cycle time for circuit board assembly process. The systems and methods described herein offer an accurate and repeatable cleaning system that eliminates human intervention and provides a user friendly approach along with improved process cycle time As mentioned above, one issue facing an operator of a multiple head dispenser is that the operator must manually clean each head or automatically clean each deposition head one at a time. Systems and methods of the present disclosure, including cleaner assembly 218, automate the cleaning of the multiple deposition heads simultaneously, thereby improving cycle time and yield without having to manually adjust the position and selection of the deposition heads. Previously it was not possible to achieve this result without spending considerable time in set-up. During program execution the needles are cleaned at once thus reducing the overall cycle time. This occurs when the circuit board is being transferred by the conveyor thereby minimizing the overall process time of the circuit board. The operation of the needle cleaner assembly 218 will be shown and described below.

In one embodiment, a method of cleaning both needles of the deposition heads is achieved as follows. Prior to any adjusting of the needles or the cleaners, the vision system offset must be set for both deposition heads. This step may be achieved by obtaining one or more images of the deposition heads with the vision system, e.g., vision system 30. Next, based on the obtained image or images, the spacing of the needles is adjusted, if necessary, by fixing the position of one needle and adjusting the position of the second needle to a desired position to match the spacing of the panels. This can be done both manually and automatically under the control of the controller. The distance between the two needles is displayed on the display. If the distance is within a predetermined tolerance, then the adjustment is complete. If the distance is not within the predetermined tolerance, then the fixed deposition head is moved and the procedure is repeated. The method may include a "Mini X,Y" or secondary stage command. If this is installed, then the "Mini X,Y" stage command will automatically adjust the offset between the needles.

The dispensing system includes two needle cleaners, a fixed needle cleaner and a movable needle cleaner. It should be understood that while the dispensing system and method of cleaning deposition heads described herein are particularly suited for cleaning a dispenser having two deposition heads, the system may be configured to provide more than two needle cleaners to simultaneously clean more than two deposition heads. To adjust the needle cleaners, one of the cleaners is disposed at a fixed position. The moveable cleaner is parked on a "Park" or "Home" command position that is a known distance from the fixed cleaner. The movable cleaner is mounted to an X-axis and a Y-axis gantry. Next, the vision system moves to the fixed cleaner and finds the center of the orifice. The vision system obtains one or more images of the fixed cleaner. The moveable cleaner is then moved by the X, Y gantry to a desired distance from the fixed cleaner. The vision system then verifies the location is correct by obtaining one or more images of the fixed and movable cleaners. This procedure will work with standard multiple head mode or with Mini X,Y adjustment mode.

As part of the operation, the vision system can verify the size of the orifice. If the size of the orifice is not the one selected by the system, the controller can operate a rotary indexer to select a correct size orifice and to move the proper orifice into place. This system also allows the left and right orifice to be set to different sizes.

As mentioned above, the method of automatically cleaning two or more deposition heads disclosed herein has the following advantages over the current multiple needle cleaner: accurate and repeatable performance; eliminate manual adjustments resulting in a fool-proof process set-up; potentially seamless implementation from customer interface perspective; and improves process cycle time.

Figure 3:
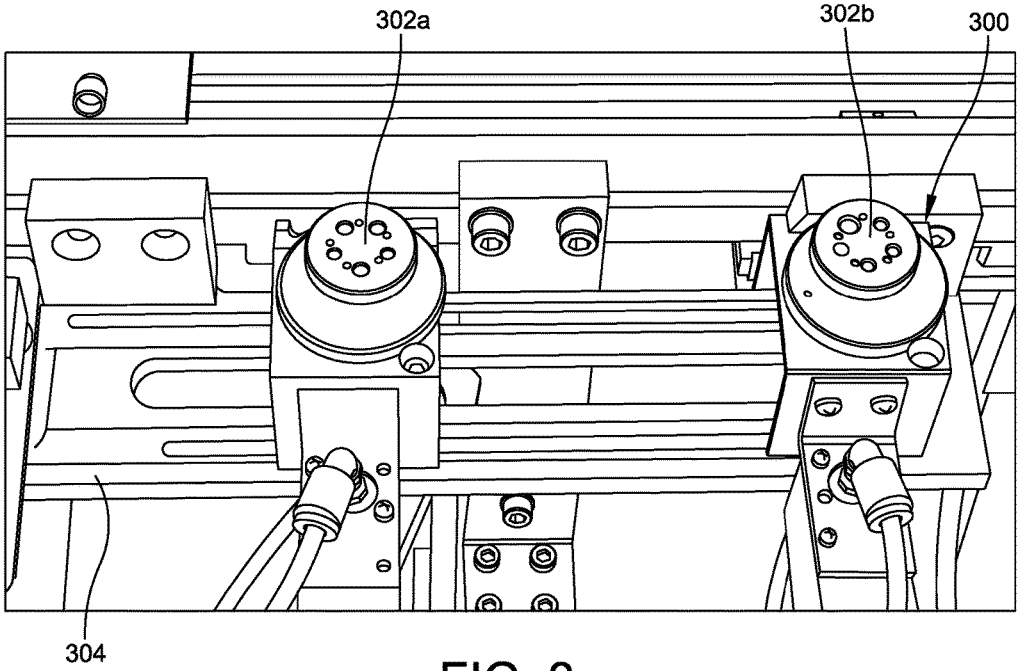
FIG. 3 is a perspective view of an exemplary needle cleaner assembly of an embodiment of the present disclosure.

Referring to FIG. 3, in one embodiment, a multiple needle cleaner assembly, generally indicated at 300, is a vacuum device that simultaneously removes material from the tips of the dispense needles of a multi-head configuration. In the shown embodiment, the multiple needle cleaner assembly 300 consists of two needle cleaners, each indicated at 302, mounted to a slotted base plate 304. The slotted base plate 304 allows for easy positioning of both the left and right needle cleaners 302*a*, 302*b* during setup and calibration of the system. During a needle clean routine, the multiple needle cleaner assembly 300 operates as follows: the dispense head positions the needles of the dispensing units over the needle cleaners 302*a*, 302*b*; the dispense heads lower the needles into orifices of the needle cleaners 302*a*, 302*b*; and the needle cleaners 302 apply vacuum, removing material from the tips of the needles. Dials of the needle cleaner assembly 300 are set to the orifices that match the needles being cleaned.

The spacing between the two needle cleaners 302 of the needle cleaner assembly 300 is the same as the spacing between the two needles of the dispensing units, e.g., dispensing units 206, 207 illustrated in FIG. 2. The right needle cleaner 302*b* as viewed in FIG. 3 is adjusted so that it is most of the way to the right of a mounting bracket. This will leave space to manually adjust the left needle cleaner 302*a* to the proper position during calibration.

Figure 4:
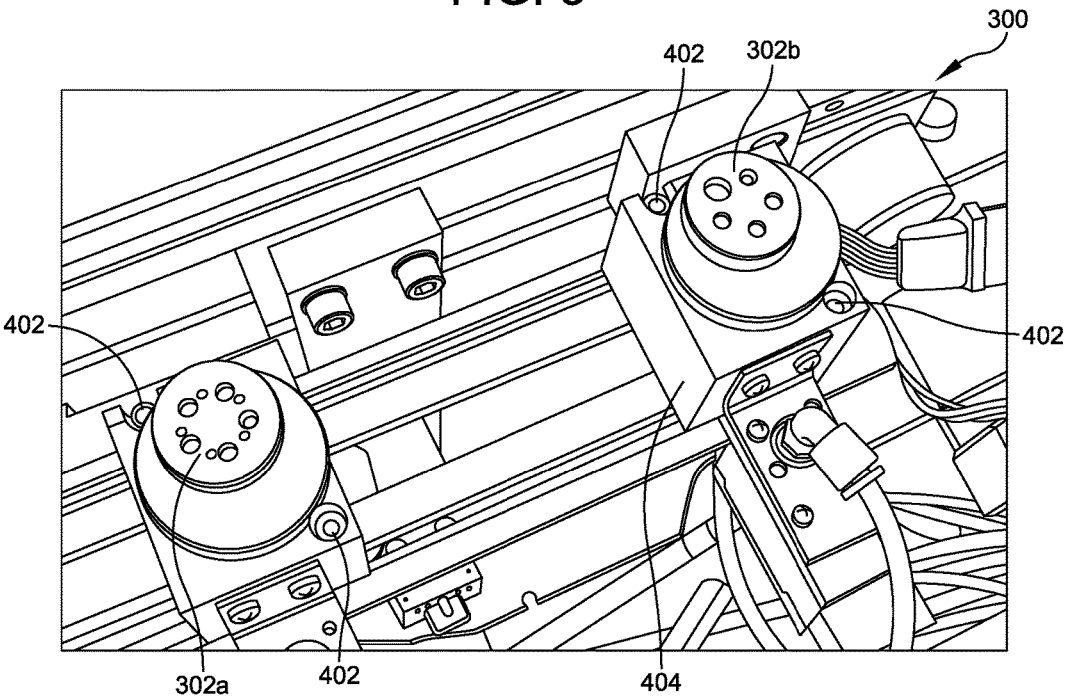
FIG. 4 is another perspective view of the needle cleaner assembly.

In one embodiment, with reference to FIG. 4, to set up the multiple needle cleaner assembly 300, the right-side needle cleaner 302*b* is adjusted. In one embodiment, to adjust the needle cleaner 302*b*, two screws, each indicated at 402, securing the right needle cleaner to a rail 404 are loosened. Next, the right needle cleaner 302*b* is slid to the right, so that there will be enough space to manually adjust the left needle cleaner 302*a* during the needle cleaner position calibration. The screws 402 are tightened to secure the needle cleaner 302*b* to the rail 404. Both of the needle cleaners 302*a*, 302*b* mount on the slotted base plate 304.

Figure 5:
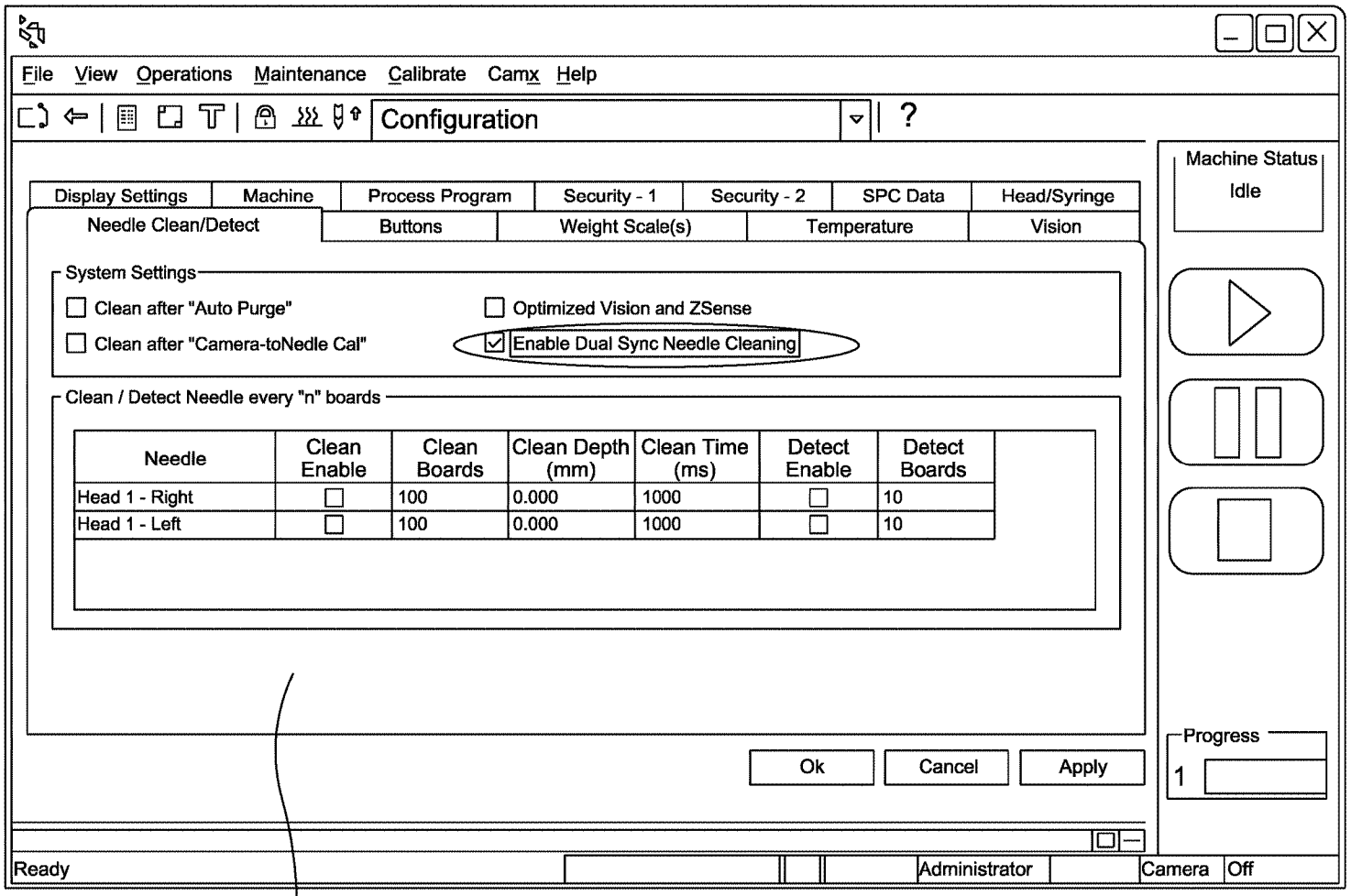
FIGS. 5-8 are screen shots of graphical user interfaces used to perform methods of the present disclosure.

Referring to FIG. 5, which illustrates a graphical user interface 500 that is displayed on a display, e.g., display 28 of the dispenser 10, to set up the software of the needle cleaner assembly, the two needle cleaners are identified within the software of the dispenser. To enable multiple needle cleaning, the operator of the dispenser selects View (pull-down)>Configuration on the graphical user interface 500. Next, the operator selects a Needle Clean/Detect tab. Next, the operator selects an Enable Dual Sync Needle Cleaning checkbox (so that a check mark is present in the box). Next, the operator selects Apply, then selects OK.

The next step after enabling the two needle cleaners is to perform a vision system to needle offset routine for both the left and right needle of the deposition heads. The system uses the offsets found during this routine to set up the position of the needle cleaners. To perform this calibration, the operator selects Calibrate (pull-down menu)>Camera to Needle Offset on the graphical user interface 500.

Figure 6:
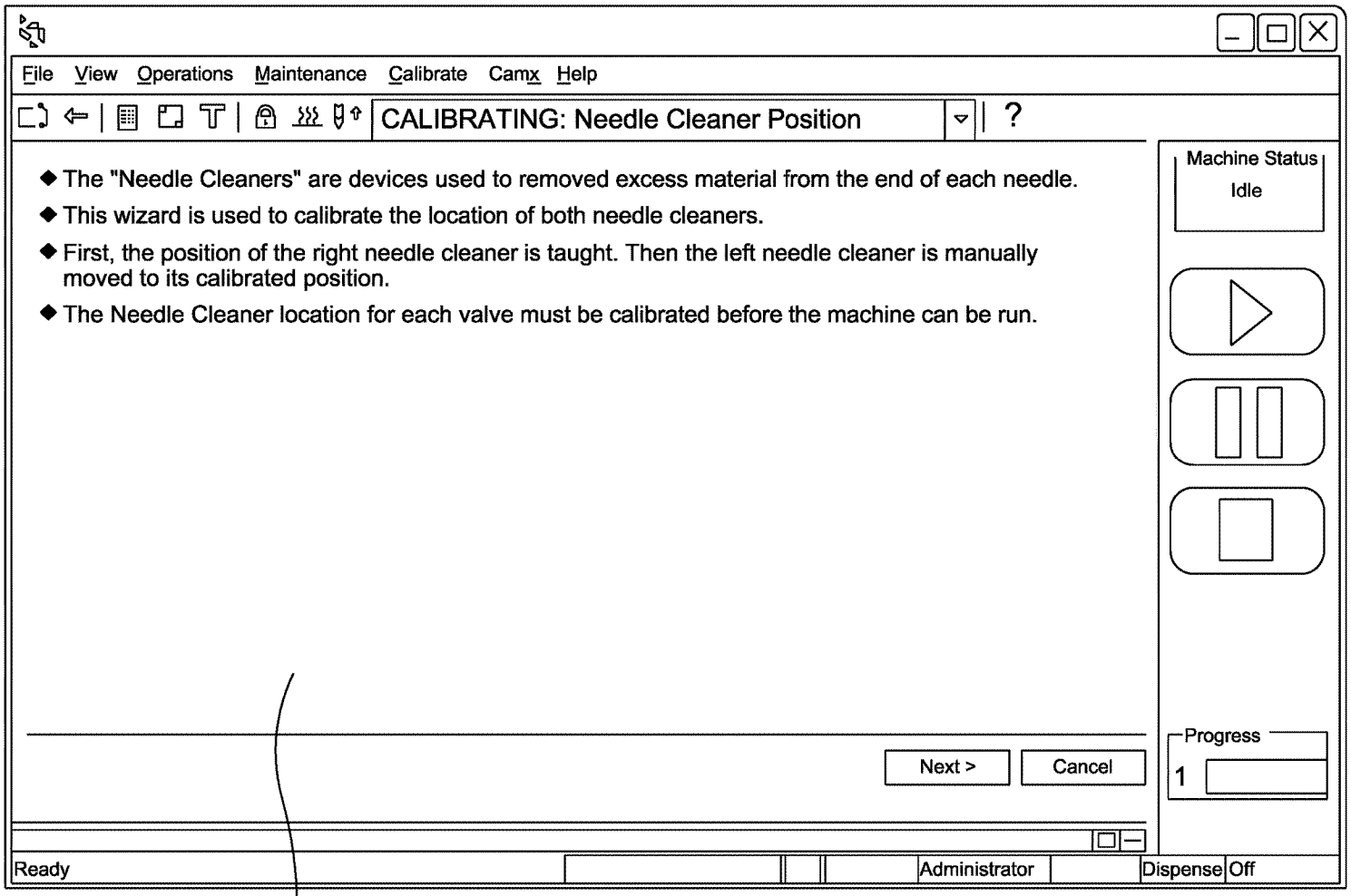

Referring to FIG. 6, which illustrates another graphical user interface 600, the multiple needle cleaner assembly position is calibrated after the vision system to needle offsets are completed. To calibrate the needle cleaner position, the operator selects Calibrate (pull-down menu)>Needle Cleaner Position on the graphical user interface 600. The operator views the interface shown in FIG. 6. As shown, the first position taught (using the vision system) is the right needle cleaner, which is taught the same as the standard, single head needle cleaner. The left needle cleaner is then manually moved to its calibrated position.

Figure 7:
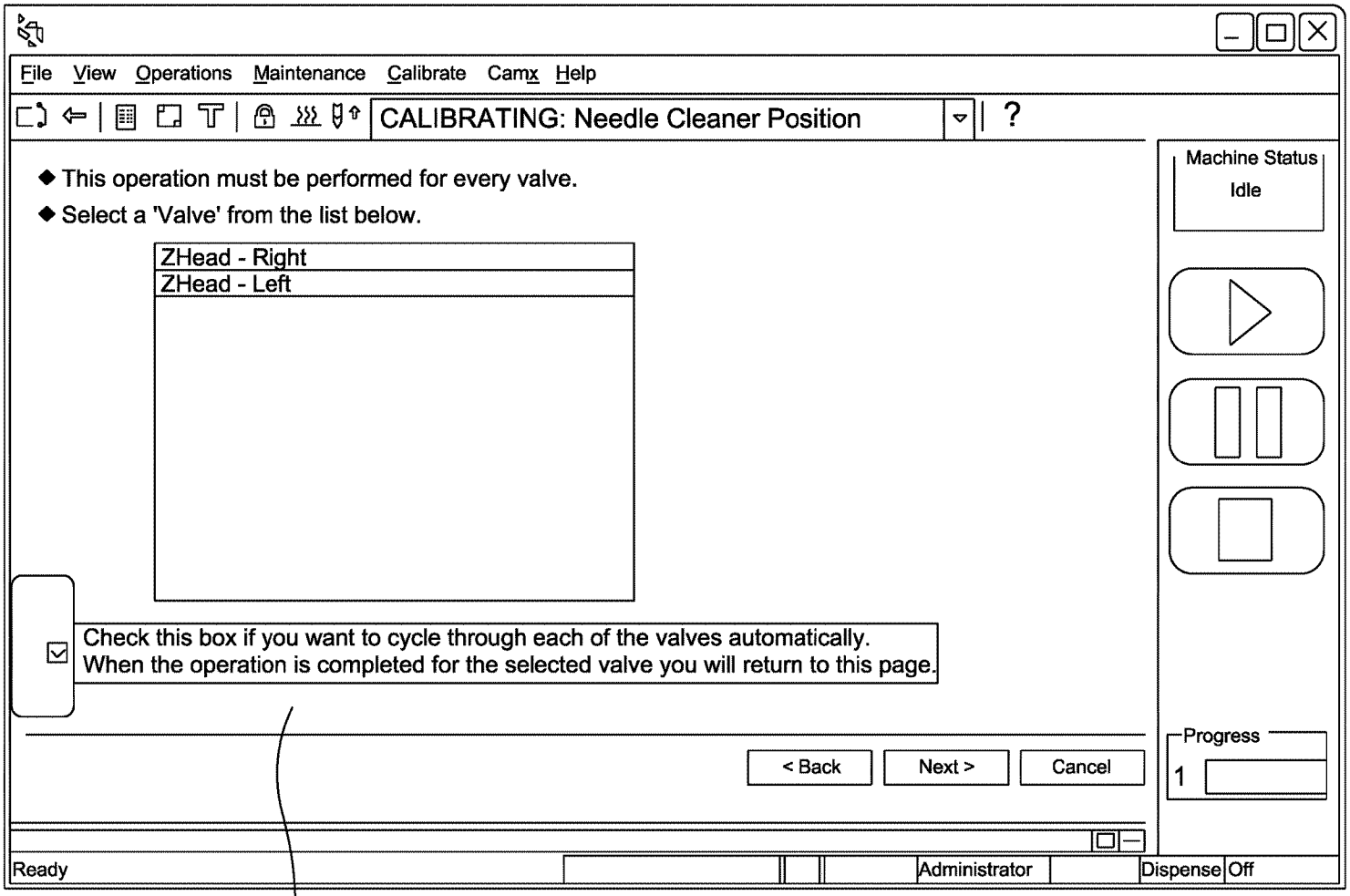

Next, with reference to FIG. 7, a graphical user interface 700 is displayed only if this calibration is being done for the first time. The operator proceeds to another step if the screen does not display. Otherwise, the operator proceeds as follows. The operator selects a Check this box if you want to cycle through . . . checkbox (so that a check mark is present in the box). The operator then selects Next. The deposition head moves into position for teaching the right needle cleaner.

Figure 8:
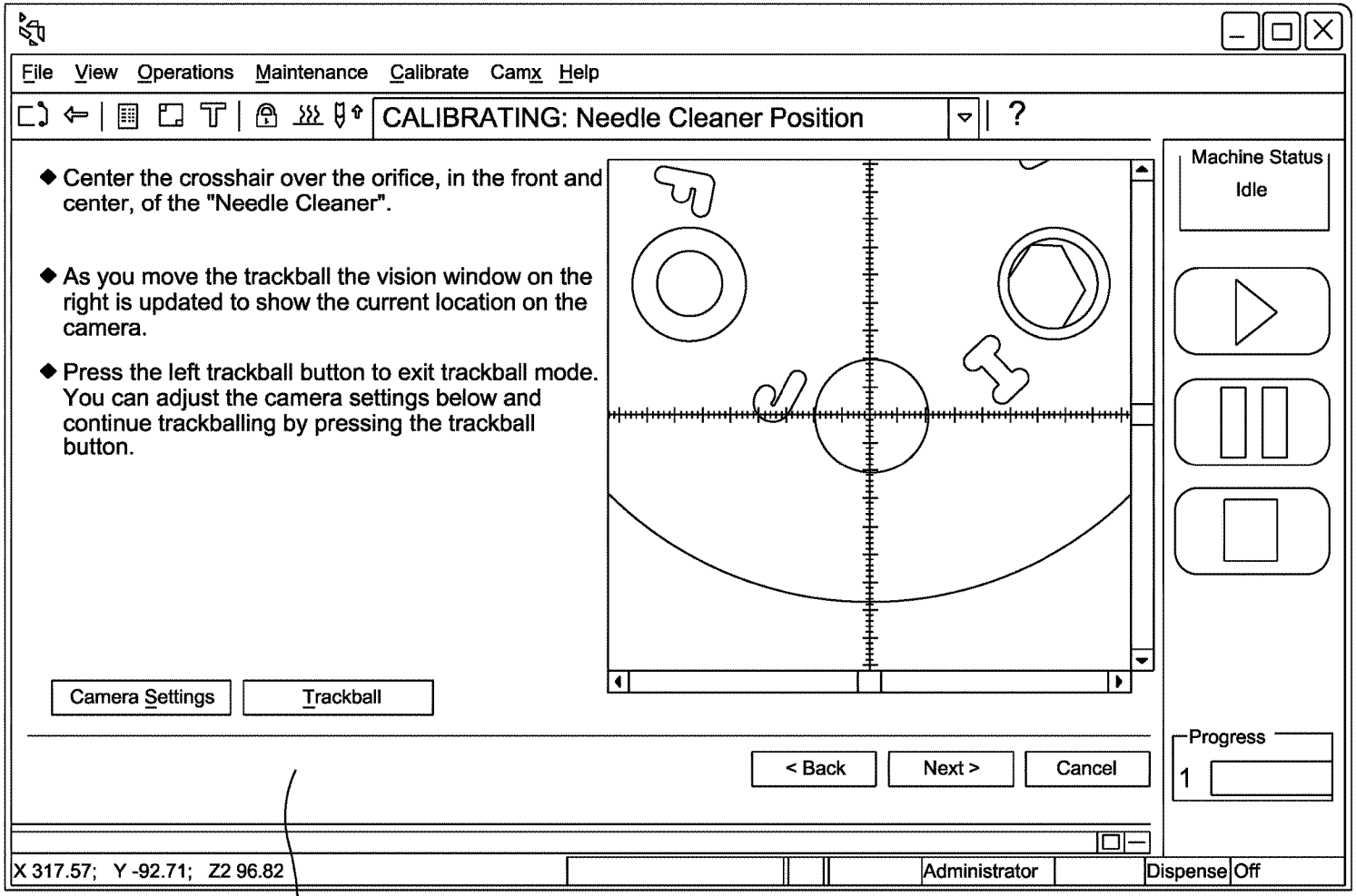

Next, the operator views a graphical user interface 800 shown in FIG. 8. As shown, the operator jogs the vision system to center the crosshair over the orifice of the needle cleaner. The operator then selects Next. The deposition head moves to where the left needle cleaner must be moved. Referring back to FIG. 3, two screws, each indicated at 402, are loosened that secure the left needle cleaner 302*a* to the rail. The needle cleaner 302 is manually positioned so that the orifice of the needle cleaner is centered in the crosshair, which is illustrated in FIG. 8. Next, the screws 402 are retightened. The operator then selects Next to complete the calibration.

Figure 9:
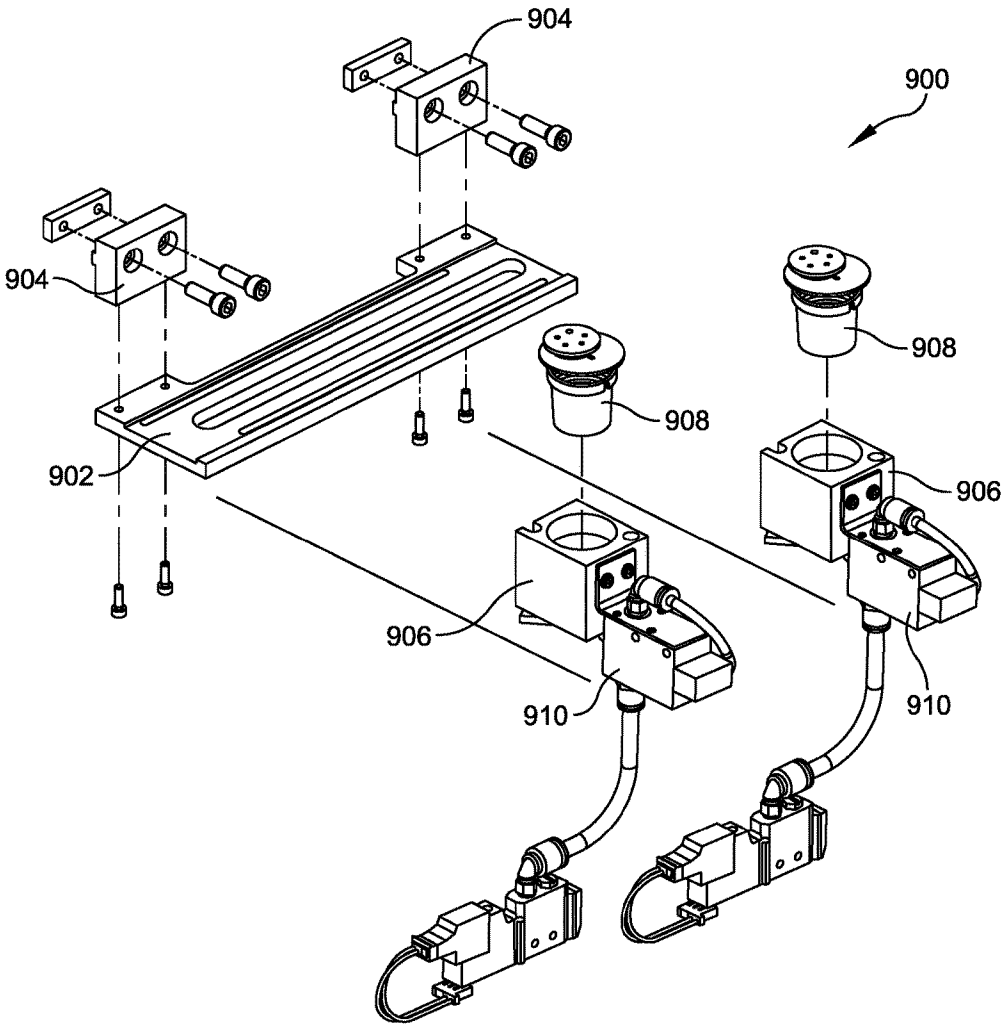
FIG. 9 is an exploded perspective view of the needle cleaner assembly.

Referring to FIG. 9, an exemplary needle cleaner assembly is generally indicated at 900. As shown, the needle cleaner assembly 900 includes a base plate 902, two mounting brackets and two needle cleaner assemblies. The base plate 902 is secured to a needle cleaner gantry (not shown) of the dispenser by means of mounting brackets 904. The needle cleaners, each indicated at 906, are secured to the base plate 902. Each needle cleaner 906 includes a cap 908 that is seated within its respective needle cleaner. Each cap 908 includes a plurality of orifices configured to receive dispensing needles of the deposition head. The orifices are sized to receive needles having different diameters. Each needle cleaner 906 includes a connector 910 that provides communication with the controller.

The teachings of the present disclosure may be applied to any type of dispensing system, including dispensing systems having jetter-type dispensing heads, to jet material onto the electronic substrate.

Having thus described several aspects of at least one embodiment of this disclosure, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A method for automatically cleaning nozzles of a material deposition system configured to deposit material on an electronic substrate, the material deposition system including two deposition heads coupled to a gantry, each deposition head including a needle, a needle cleaner assembly movable on a needle cleaner gantry, the needle cleaning assembly being configured to clean needles of the deposition heads simultaneously, the method comprising:

performing a deposition operation with the material deposition system;

cleaning needles of the two deposition heads simultaneously with the needle cleaner assembly, the needle cleaner assembly including a base plate secured to the needle cleaner gantry by two brackets and two needle cleaners, one for each deposition head, secured to the base plate, the base plate having a slot formed therein to enable positioning of the two needle cleaners during setup and calibration of the system; and adjusting a spacing between the two needle cleaners by sliding a first needle cleaner with respect to a second needle cleaner along a length of the base plate to correspond to a spacing between the two needles of the dispensing units.

2. The method of claim 1, wherein cleaning needles of the two deposition heads includes obtaining at least one image of the needle cleaners with a vision system and determining offset distances between the deposition heads and the needle cleaners.

3. The method of claim 2, wherein cleaning needles of the two deposition heads further includes adjusting a spacing of the needles by fixing the position of one needle and adjusting the position of the other to a desired position.

4. The method of claim 3, wherein adjusting the spacing of the needles is performed by a controller of the material deposition system.

5. The method of claim 3, wherein the spacing of the needles is displayed on a display on the material deposition system.

6. The method of claim 3, wherein if the spacing of the needles is not within a predetermined tolerance, then the adjustable needle is moved and the cleaning process is repeated.

7. The method of claim 1, wherein the needle cleaner assembly is mounted on a gantry configured to move the needle cleaner assembly in at least one of an X-axis direction and a Y-axis direction.

8. The method of claim 1, further comprising verifying a size of a needle orifice for each deposition head.

9. The method of claim 8, further comprising operating a rotary indexer to select a correct size of the needle orifice and to move the proper needle orifice into place.

* * * * *